US008672699B2

(12) United States Patent
Gaertner

(10) Patent No.: US 8,672,699 B2
(45) Date of Patent: Mar. 18, 2014

(54) AUTOMATIC CONNECTOR WITH INDICATOR

(75) Inventor: Ernst M. Gaertner, Arlington Heights, IL (US)

(73) Assignee: MacLean Power Systems LLC, Fort Mill, SC (US)

( * ) Notice: Subject to any disclaimer, the term of this patent is extended or adjusted under 35 U.S.C. 154(b) by 0 days.

(21) Appl. No.: 12/695,157

(22) Filed: Jan. 28, 2010

(65) Prior Publication Data

US 2011/0183539 A1 Jul. 28, 2011

(51) Int. Cl.
*H01R 4/50* (2006.01)
*H01R 13/625* (2006.01)

(52) U.S. Cl.
USPC ..... 439/345; 439/820

(58) Field of Classification Search
USPC ..... 439/345, 820, 769
See application file for complete search history.

(56) References Cited

U.S. PATENT DOCUMENTS

| | | | | | |
|---|---|---|---|---|---|
| 2,138,913 | A | * | 12/1938 | Fotsch | 403/303 |
| 2,158,892 | A | * | 5/1939 | Becker | 439/863 |
| 2,161,694 | A | * | 6/1939 | Becker | 439/820 |
| 2,222,493 | A | * | 11/1940 | Barlow | 403/303 |
| 2,535,623 | A | * | 12/1950 | Becker | 439/820 |
| 2,554,387 | A | * | 5/1951 | Saul | 403/327 |
| 2,966,653 | A | * | 12/1960 | Jugle | 403/314 |
| 3,072,989 | A | * | 1/1963 | Jugle et al. | 403/13 |
| 4,362,352 | A | * | 12/1982 | Hawkins et al. | 439/788 |
| 7,219,399 | B2 | * | 5/2007 | Tamm et al. | 24/136 R |

* cited by examiner

*Primary Examiner* — Hae Moon Hyeon
(74) *Attorney, Agent, or Firm* — Brinks Gilson & Lione

(57) ABSTRACT

Disclosed herein are embodiments of a connector comprising a shell with a shell axis, a shell opening, a plurality of retaining structures, an inner shell surface, and an outer shell surface; the retaining structures are, at least in part, configured to retain a spring in a compressed state; a plurality of clamping members axially located within the shell between the spring and the shell opening; and a release that is generally coaxial with the shell opening and configured to release the compressed spring when a cable is inserted past the clamping members.

11 Claims, 16 Drawing Sheets

AUTOMATIC CONNECTOR WITH INDICATOR

FIELD

Embodiments disclosed herein relate to automatic connectors, splices, and dead-end connectors.

BACKGROUND

Automatic connectors are known and used to splice together strands and wires and mount strands and wires in dead-end applications. Such automatic connectors are provided with a tube that has a taper and a circular opening, clamping members with teeth disposed within the tube, and a spring. The spring biases the clamping members towards the circular opening in the tube. During installation, a strand or wire is inserted through the circular opening, pushing the clamping members axially within the tube until the strand or wire separates the clamping members to extend between the clamping members thereby beginning to engage the teeth.

Though such automatic connectors have been generally adequate, they suffer from certain limitations that require strict adherence to installation instructions. One of those installation instructions includes the need to insert fully a strand or wire beyond the clamping members in order to achieve complete engagement of all of the clamping members' teeth. To ensure that any strand or wire is fully inserted, it is often necessary to measure the strand or wire against the connector to know the proper length that must be inserted. Once this proper length is determined, the strand or wire is marked with tape and inserted into the automatic connector up to the taped marking.

Under difficult outdoor conditions (rain or ice storms), it is not unusual for users to dispense with proper installation techniques, such as marking strands with tape. As a result, the strand or wire may not be inserted past the clamping members with the result that the teeth are not fully engaged or the guide cup does not pass through the clamping members, preventing them from properly gripping the wire. Because the teeth begin to engage the strand or wire and because the degree of engagement is hidden within the tube, users cannot distinguish between complete and incomplete engagement of the clamping members teeth. When the teeth of the clamping members are not fully engaged, the strand or wire may be pulled out of the connector resulting in significant personal injury or damage to property.

Consequently, there has been a long-felt need for an automatic connector that enables users to know whether a sufficient length of a strand or wire has been inserted within the connector to engage fully the teeth on the clamping members. The present invention meets this long-felt need with multiple solutions: first by preventing the clamping members from engaging unless the strand or wire is fully inserted axially past the clamping members, and second, in an alternative embodiment, by providing with an indicator that signals to the user that complete insertion (and hence full engagement with the teeth) has been achieved. Other advantages will be apparent in the following written description.

SUMMARY

The scope of the present invention is defined solely by the appended claims, and is not affected to any degree by the statements within this summary. Disclosed herein are embodiments of an automatic connector. One embodiment comprises a connector including a shell with a shell axis, a shell opening, a plurality of retaining structures, an inner shell surface, and an outer shell surface; the retaining structures are, at least in part, configured to retain a spring in a compressed state; a plurality of clamping members axially located within the shell between the spring and the shell opening; and a release that is generally coaxial with the shell opening and configured to release the compressed spring when a cable is inserted past the clamping members.

DETAILED DESCRIPTION

Figure 1:
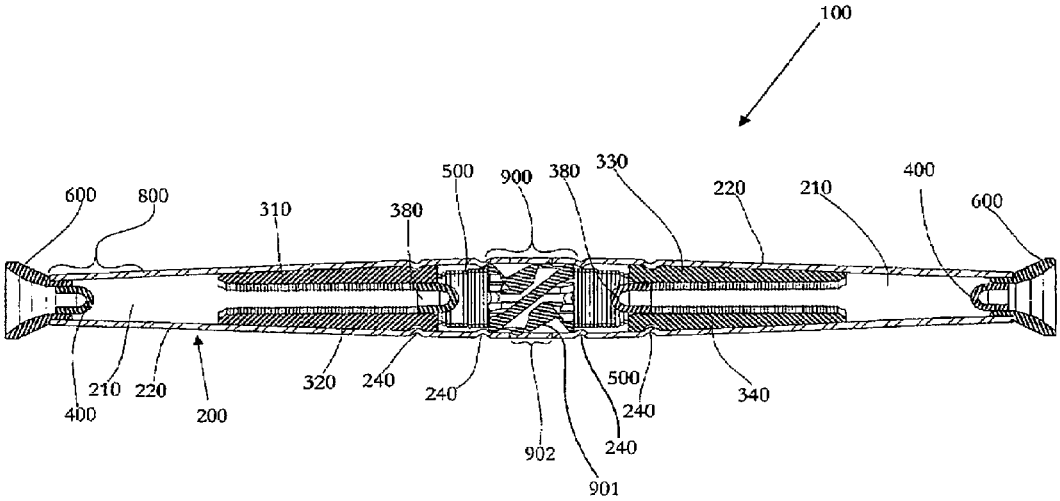
FIG. 1 is a cross-sectional view of an automatic connector with a retaining structure and a spring in a compressed state.

FIG. 1 depicts a presently preferred embodiment of a connector 100. As shown thereon, the connector 100 is provided with a shell 200, a plurality of clamping members 300 (referred to herein at "310", "320", "330", and "340") a pilot cup 400, and a spring 500. As is also shown in FIG. 1, the connector 100 includes a funnel 600, which is located at an opening 700 provided at an end 800 of the shell 200. The connector 100 of FIG. 1 is commonly known as a "splice" and hence is provided with two chambers 110, 111 (referred to as a "first chamber 110" and a "second chamber 111" to distinguish one from the other). The chambers 110, 111 are separated via a barrier 112 which is held in place by a plurality of retaining structures 240.

Figure 2:
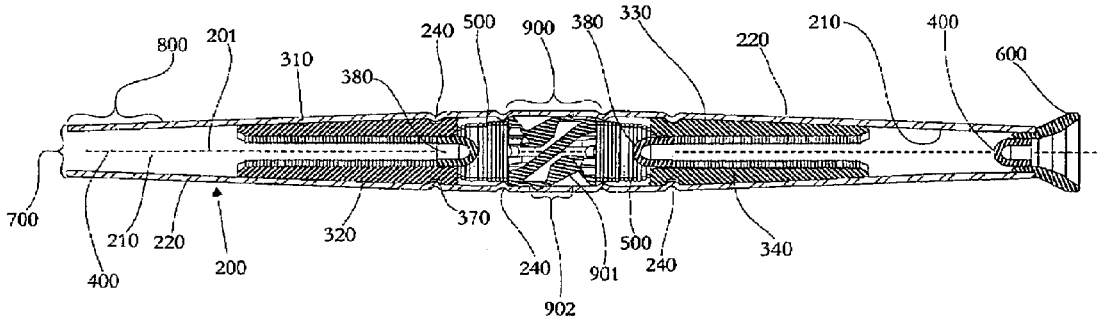
FIG. 2 is a cross-sectional view of an automatic connector with a retaining structure and a spring in a compressed state.
Figure 14:
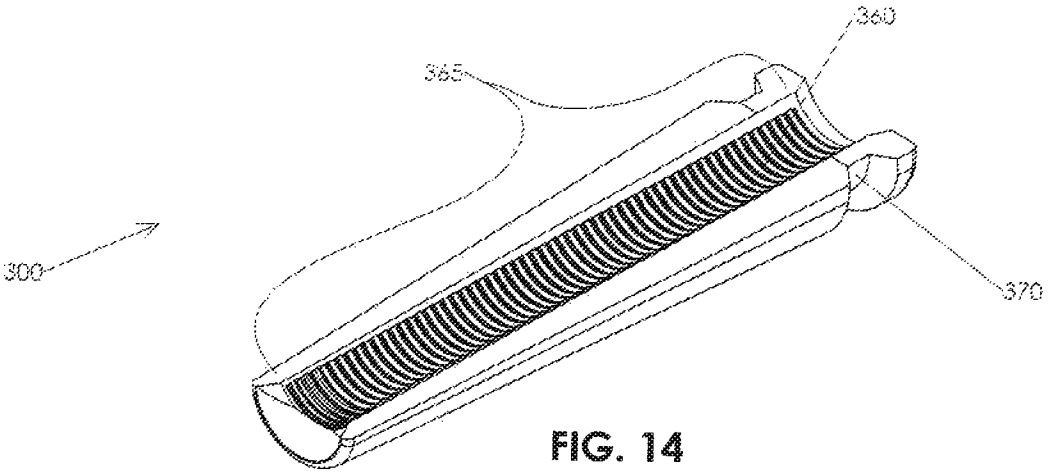
FIG. 14 is a perspective view of a jaw.
Figure 15:
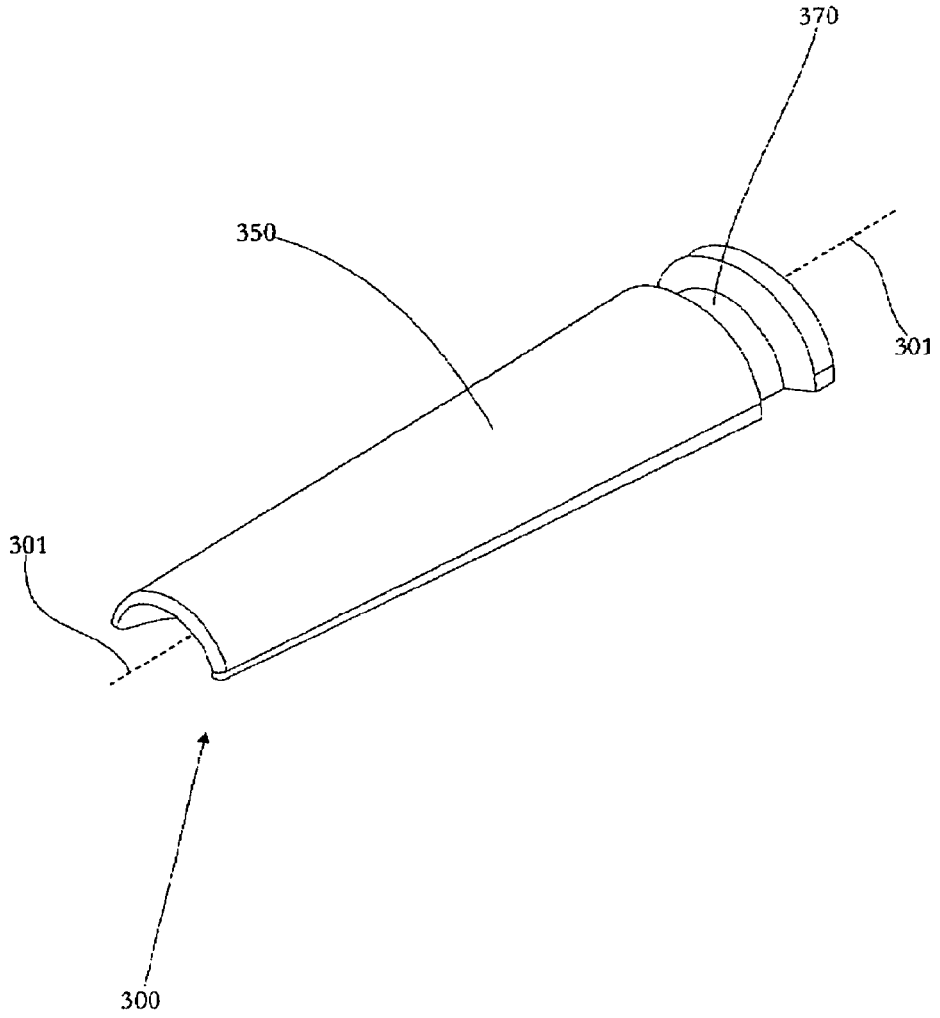
FIG. 15 is a perspective view of a jaw.

Referring now to FIGS. 2, 14, and 15, the clamping member 300 includes an outer clamping surface 350 and an inner clamping surface 360. The outer clamping surface 350 is provided with a lower coefficient of friction relative to the inner clamping surface 360, which is provided with a higher coefficient of friction. Advantageously, the outer clamping surface 350 is smooth while the inner clamping surface 360 is provided with a plurality of ridges (which are collectively designated "365."). Though the inner clamping surface 360 is shown with ridges 365, other configurations are within the scope of the present invention. By way of example and not limitation, the inner clamping surface 360 is provided with a plurality of teeth. As the foregoing illustrates, the inner clamping surface 360, of the clamping member 360 is configured to clamp and retain a strand or a wire (referred to herein generically as a "cable 50") while the outer clamping surface 350 is configured to cooperate with the shell 200.

The shell 200 is provided with an inner shell surface 210, an outer shell surface 220, a shell thickness 230, and a shell axis 201. In the presently preferred embodiment, the inner shell surface 210 is configured to cooperate with the clamping member 300. More specifically, the inner shell surface 210 is shaped so that the clamping member 300 slides axially within the shell 200. In the preferred embodiment, the outer clamping surface 350 is in sliding engagement with the inner shell surface 210. Thus, the outer clamping surface 350 slides along the inner shell surface 210. This sliding engagement also provides for an electrical connection between the clamping members and the shell.

The inner shell surface 210 also provided with a taper (which is designated "211"). The taper 211 is dimensioned to cooperate with the clamping member 300. As FIG. 1 makes evident, the taper 211 is shaped so that the clamping member 300 extends radially from the shell axis 201 as the outer clamping surface 350 slides axially along the inner shell surface 210 away from the opening 700 of the shell 200.

Referring now to FIG. 15, the clamping member 300 is shown with a generally cylindrical outer clamping surface 350, a clamping axis 301, and a clamp retainer 370. The clamp retainer 370 is in the form of a groove that is circular and oriented to extend around the generally cylindrical outer clamping surface 350 (and hence lies within a plane that is orthogonal relative to the shell axis 201)

Figure 11:
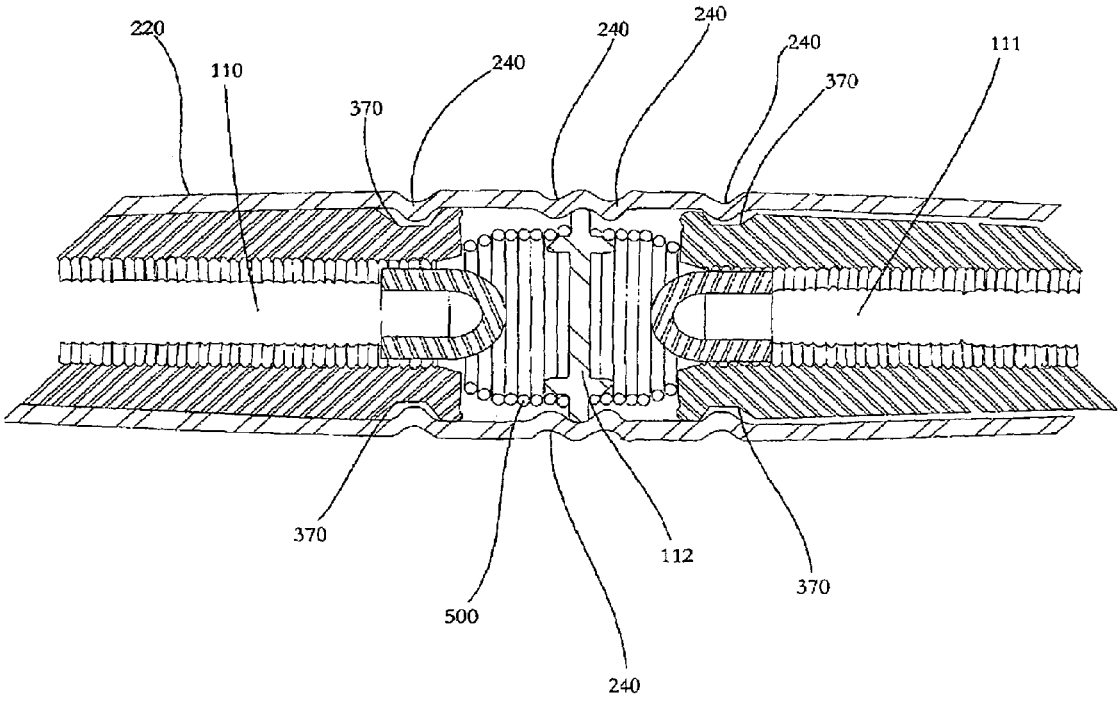
FIG. 11 is a cross-sectional view of a portion of an automatic connector.
Figure 12:
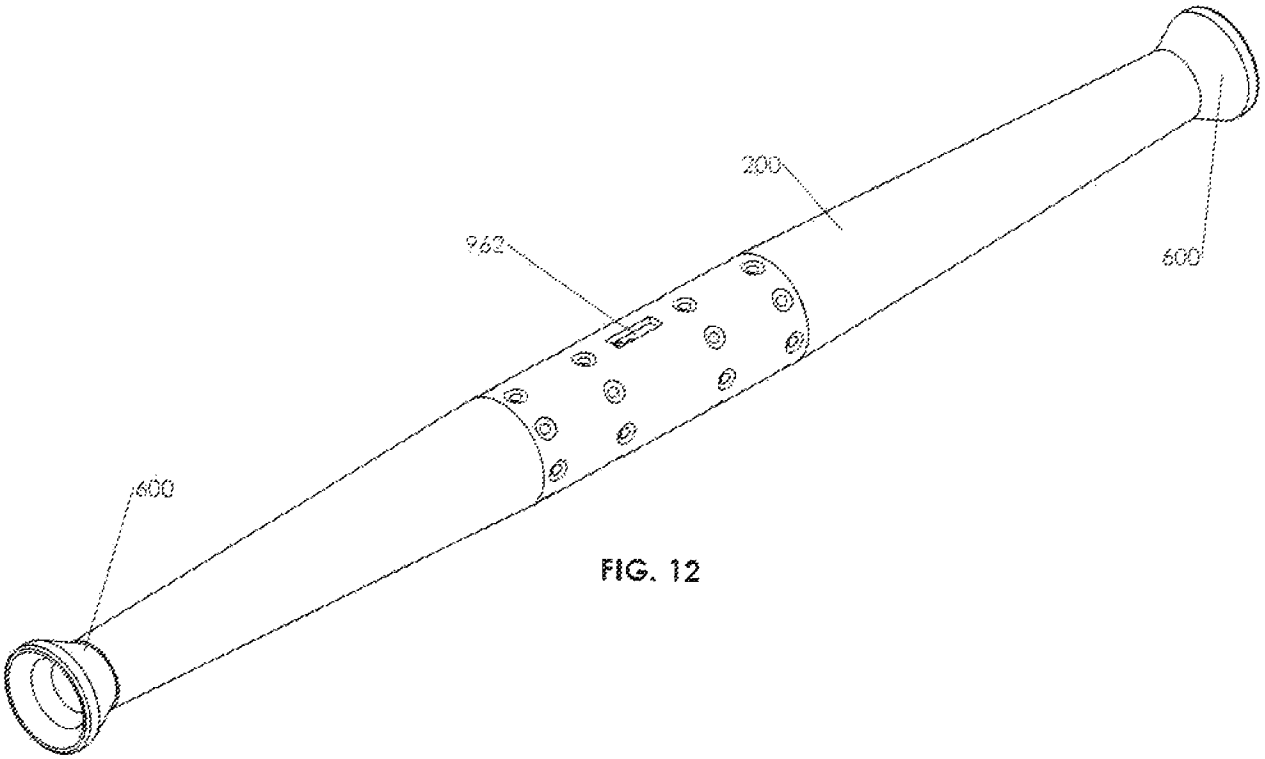
FIG. 12 is a perspective view of an automatic connector.
Figure 13:
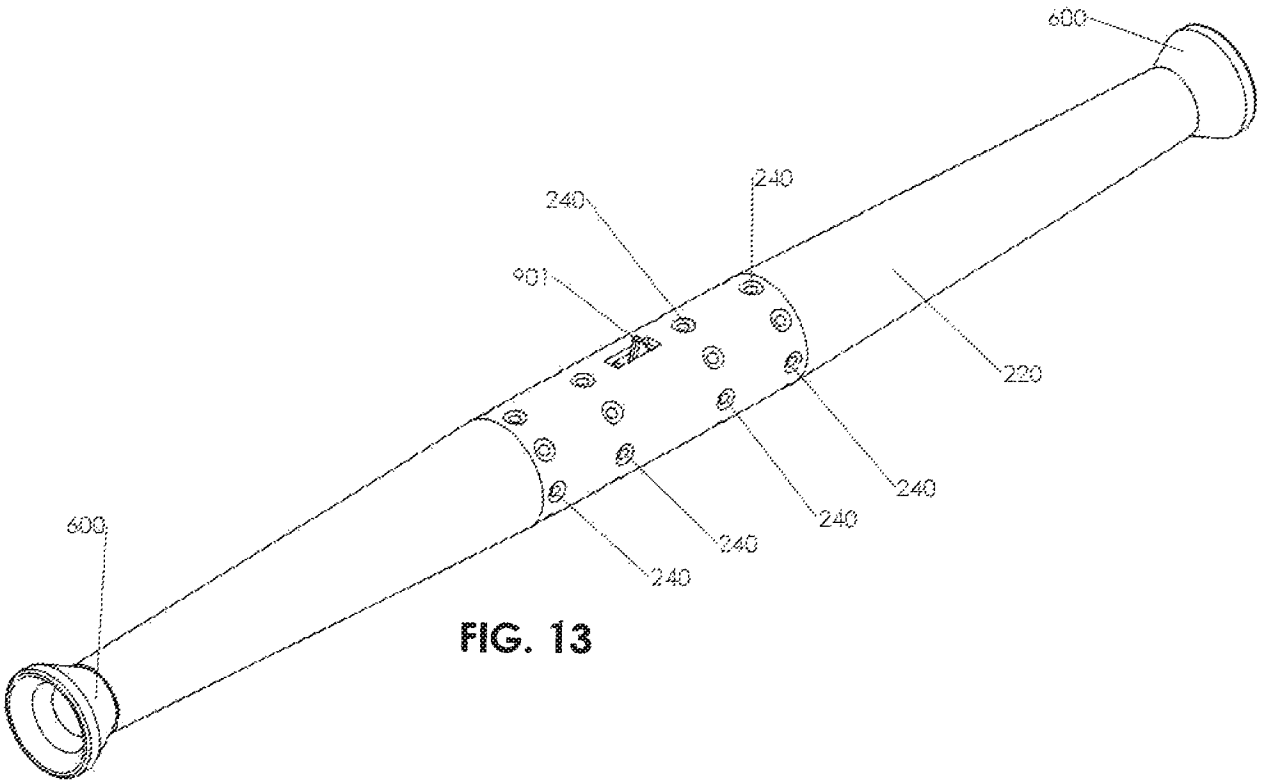
FIG. 13 is a perspective view of an automatic connector.

The shell 200 is provided with a plurality of retaining structures 240. The retaining structures 240 shown in the preferred embodiment are in the form of a plurality of indentations. The retaining structures 240 are positioned so as to retain the clamping members 310, 320, 330, 340 axially within the shell 200. As FIG. 11 and FIG. 13 illustrate, the retaining structures 240 are located radially about the shell axis 201 on the outer shell surface 220. More specifically, the retaining structures 240 are positioned so that the spring 500 is compressed (thereby providing the connector 100 with spring-loaded clamping members 300). As FIG. 1 and FIG. 11 illustrate, the retaining structure 240 fits within the clamp retainers 370 on the clamping member 300 so that the clamping member 300 is removeably fixed axially within the shell 200 and the clamping member itself compresses the spring 500.

Figure 3:
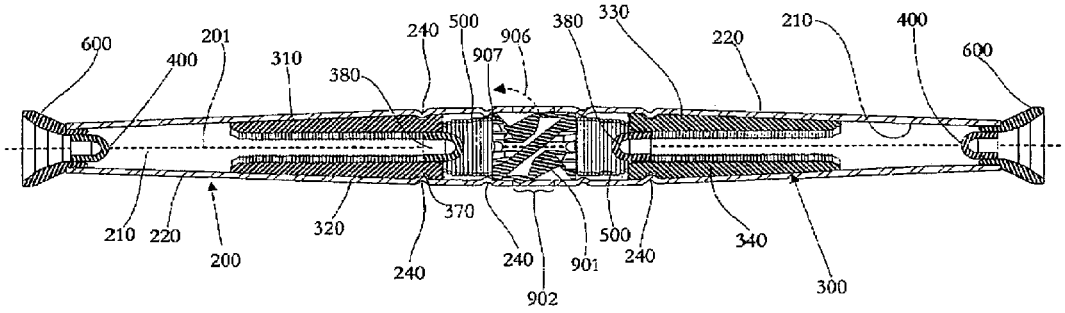
FIG. 3 is a cross-sectional view of an automatic connector with a retaining structure and a spring in a compressed state.

The clamping member 300 is removeably fixed within the shell 200 in that a release 380 in the form of a cup disposed between the inner clamping surfaces of two clamping members, as FIG. 3 depicts in greater detail. As FIG. 3 also depicts in greater detail, the release 380 is generally coaxial. In operation, a cable is inserted through the funnel 600, through the opening 700, between the clamping members 310, 320 to the release 380. The cable pushes the release 380 from its position within the inner clamping surfaces of the clamping members 310, 320 so that the clamping members 310, 320 (and hence the clamp retainers 370 on each of the clamping members 310, 320) are no longer held in place by the retaining structures 240 of the shell 200. More specifically, the clamping members 310, 320 are free to move away from the inner shell surface 210 towards the shell axis 201. Thus, the retaining structures 240 no longer hold the clamping members 310, 320 axially in place. Because the spring 500 is compressed (and as noted above, nothing holds the clamping members 310, 210 axially), the spring 500 forces the clamping members 310, 320 along the taper 211 of the inner shell surface 210 until the inner clamping surfaces 360 clamp the cable 50.

FIGS. 4-9 depict an alternative embodiment of the present invention. As shown therein, the connector 100 is provided with a communication structure 900 (as is designated in FIG. 2) that includes an indicator. In the embodiments shown in FIGS. 4-9, the indicator is in the form of a tab 901 that extends through a port 902 linking the outer shell surface 220 and the inner shell surface 210. The communication structure 900 is also provided with a guide 903 that cooperates with the cable when the cable is inserted into the shell 200, past the opening 700 to extend axially beyond the clamping members 300.

Figure 7:
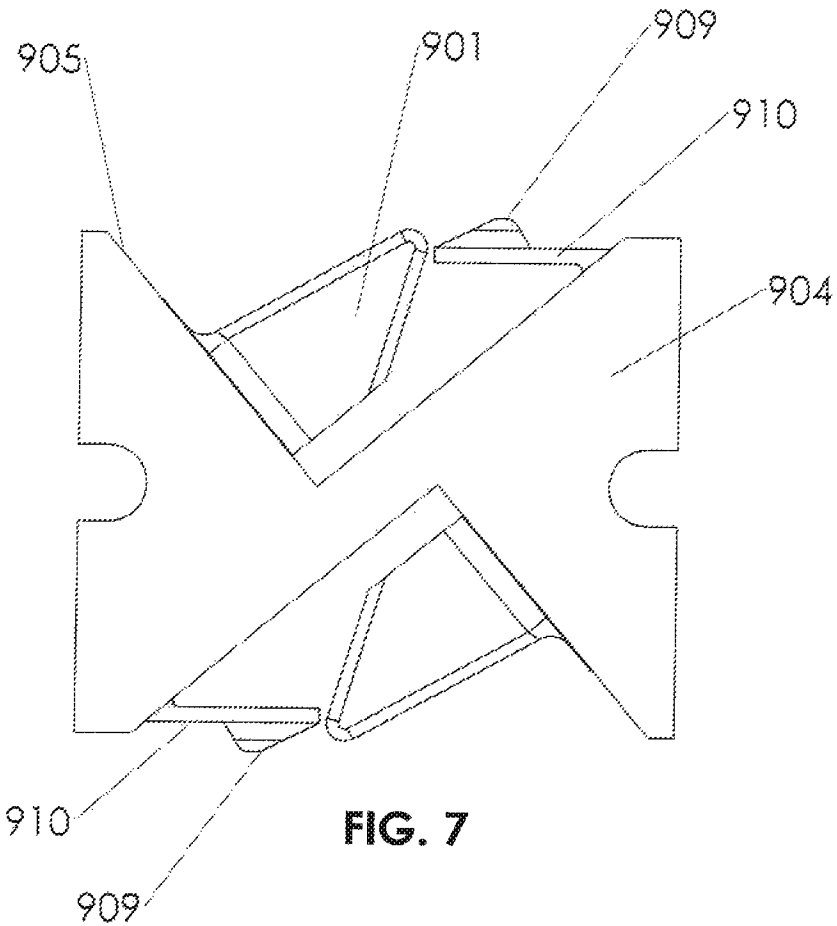
FIG. 7 depicts a communication structure that includes an indicator n the form of a tab.
Figure 8:
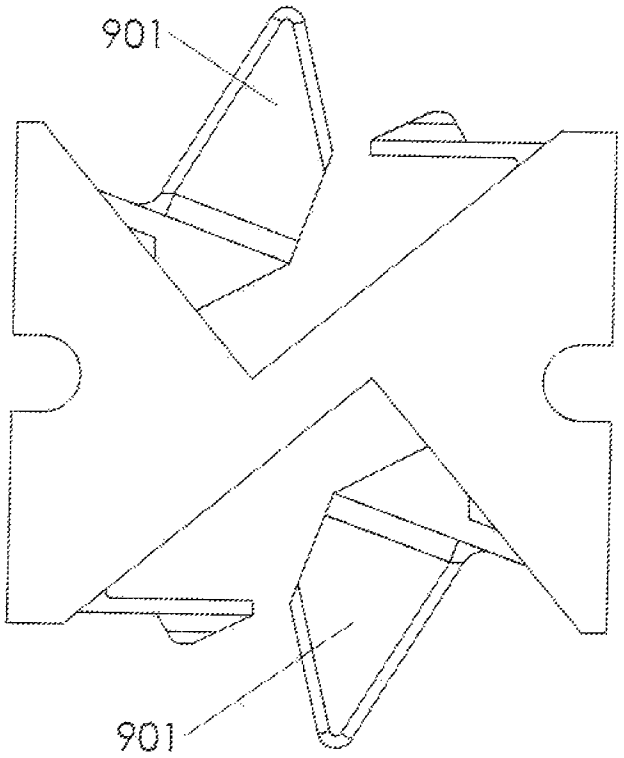
FIG. 8 depicts a communication structure that includes an indicator n the form of a tab.
Figure 9:
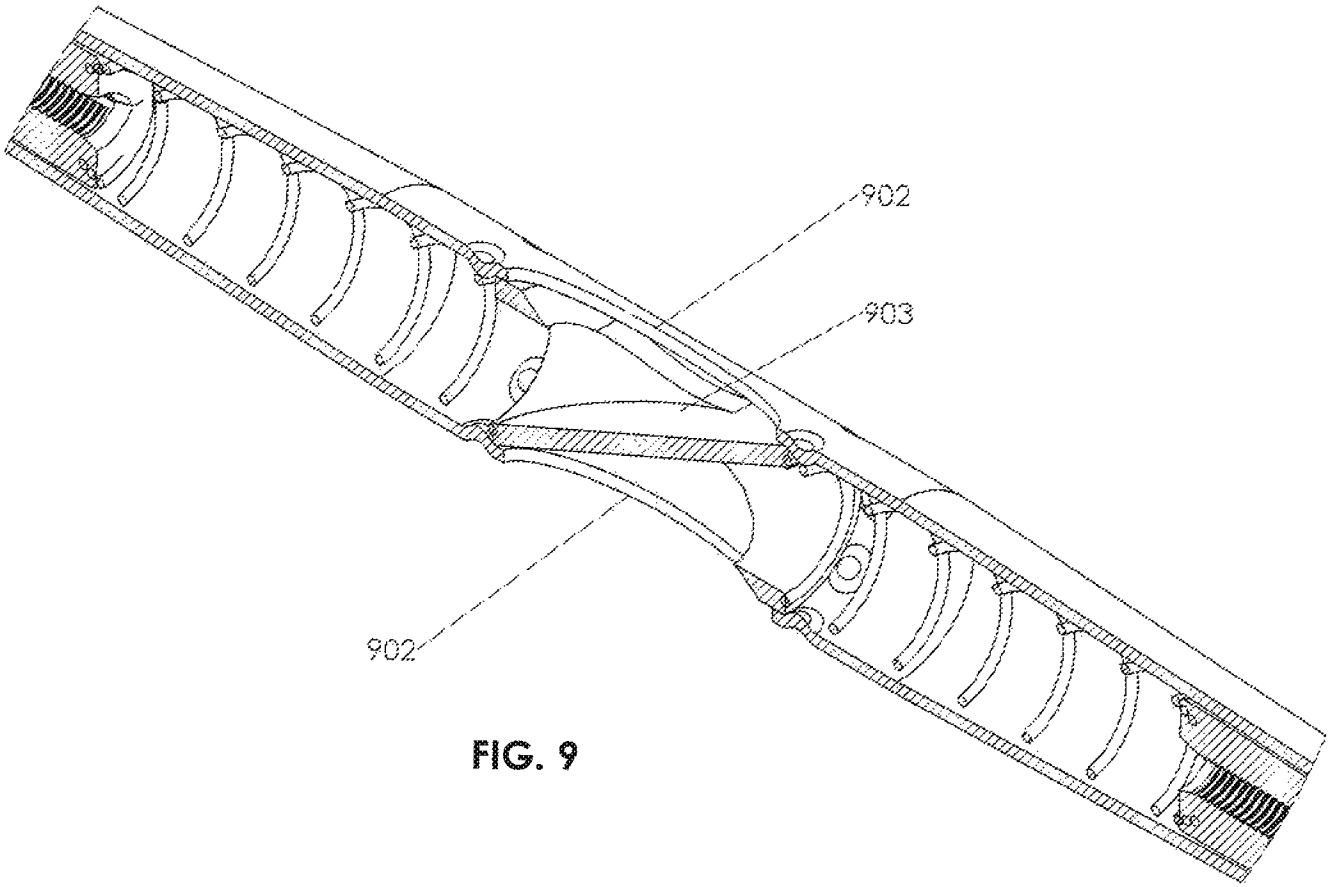
FIG. 9 is a cross-sectional view of a portion of an automatic connector.
Figure 10:
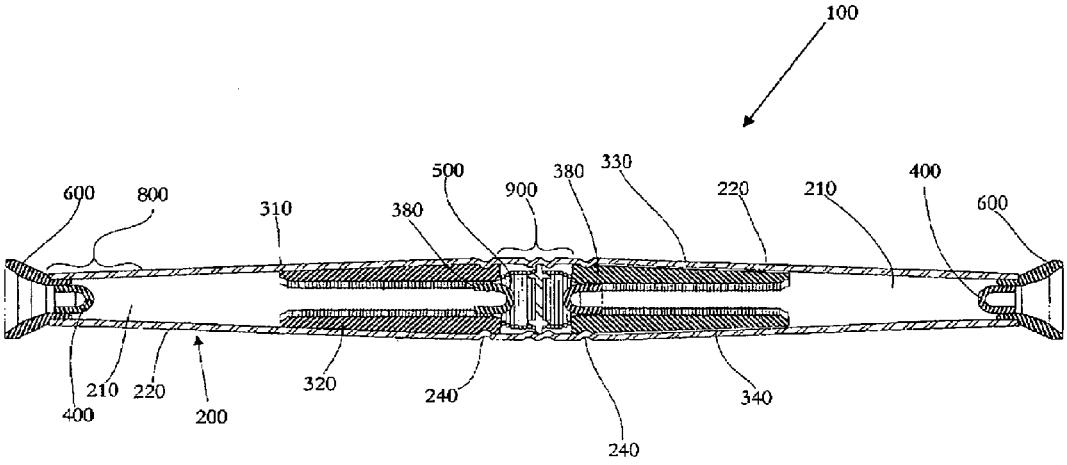
FIG. 10 is a cross-sectional view of an automatic connector.

In the embodiments shown in FIGS. 7-9, the tab 901 is connected to a plastic substrate 904 via a living hinge 905, and thus, the tab 901 moves through an arc 906 (shown as a dashed line) and extends through the port 902 beyond the outer shell surface 220. When the cable is extended axially beyond the clamping members 300, the end of the cable moves through a passage 907 within the communication structure 900 and contacts the tab 901 and pushes the tab 901 through the port 902 so that the tab 901 visibly extends beyond the outer shell surface 220. As FIG. 7 shows, the communication structure 900 is provided with a positioning tab 909 on a cantilever 910 which enables the communication structure 900 to be snap-fit into place within the shell 200. Thus, the positioning tab 909 extends through the port 902 to hold the communication structure 900 axially in place within the shell 200.

Figure 4:
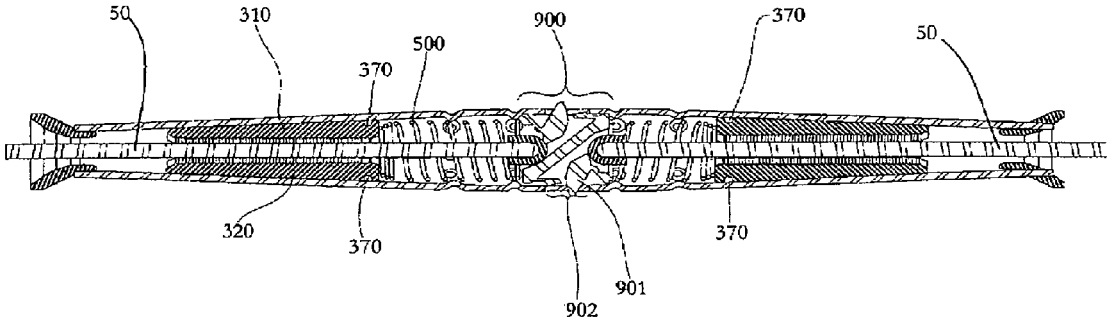
FIG. 4 is a cross-sectional view of an automatic connector with a cable inserted therein.
Figure 5:
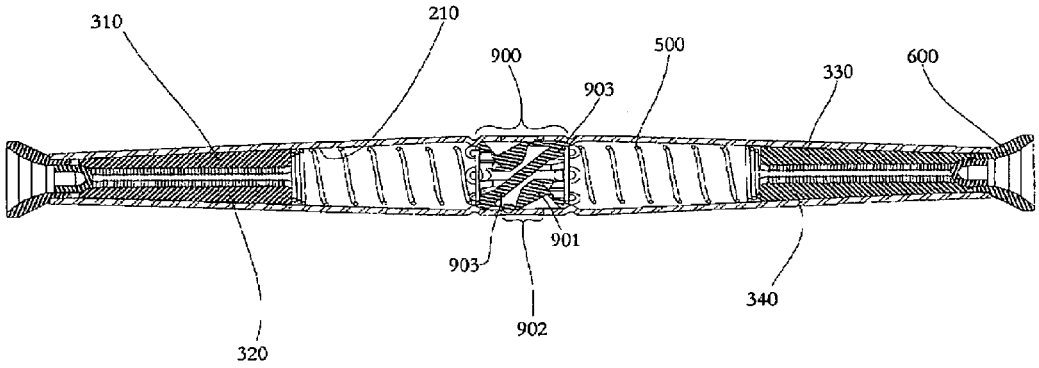
FIG. 5 is a cross-sectional view of an automatic connector.
Figure 6:
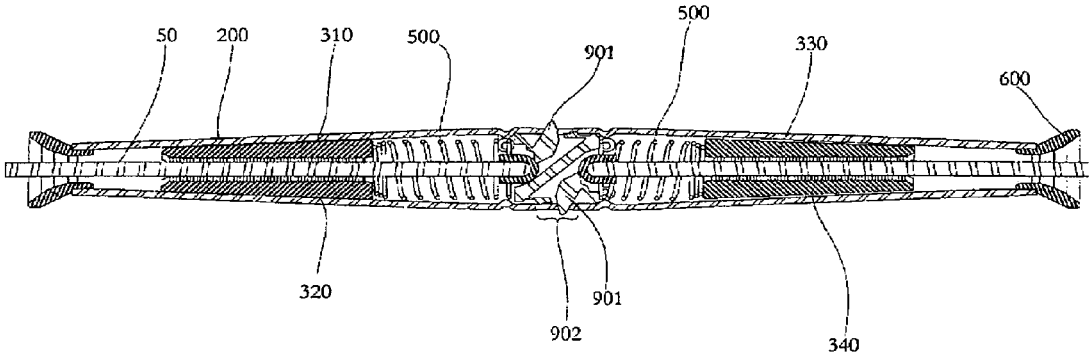
FIG. 6 is a cross-sectional view of an automatic connector.

FIG. 2 and FIG. 5 depict yet another alternative embodiment of the present invention. Like the embodiment shown in FIG. 3, the each connector 100 shown in FIG. 2 and FIG. 5 is provided with a communications structure 900 that includes an indicator; however, the embodiment shown in FIG. 4 uses the end of the cable to function as an indicator. In such an arrangement, the cable is advanced axially past the opening 700 of the shell 200 and the clamping members 300. The end of the cable contacts the guide 903 and is forced along the guide 903 through the port 902. Thus, the end of the cable provides a visual indication that the end of the cable extends beyond the clamping members 300.

While FIGS. 3 and 4 depict connectors 100 provided with communication structures 900 and FIG. 1 depicts a connector 100 provided with spring-loaded clamping members 300, it bears noting the spring-loaded clamping members 300 of FIG. 1 can be combined with a communication structure 900, as is shown in FIGS. 4 and 5. Additionally, it bears noting that, though the connectors 100 depicted herein are splices and hence provided with two chambers 110, 111 separated via a barrier 112, nothing herein prevents a connector 100 from being used as a dead-end connector, and hence provided with a single chamber.

When a connector 100 is used as a conductor, heat can build up if the connection creates undue electrical resistance. Consequently, it is advantageous to determine when heat builds up as a result of a connector functioning improperly. Accordingly, in an alternative embodiment, a sleeve 120 fabricated from a color changing material so that heat build up can be detected by simply viewing the color of the sleeve.

Figure 16:
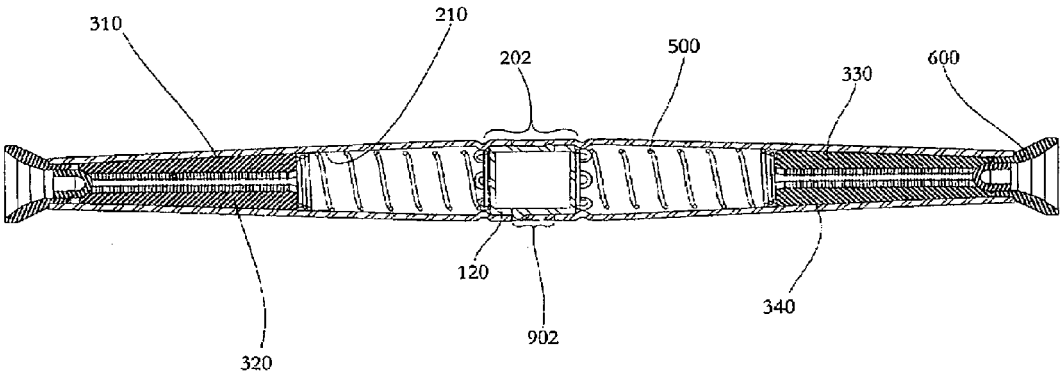
FIG. 16 is a cross-sectional view of an automatic connector with a sleeve located about the center portion of the shell.

FIG. 16 depicts an automatic connector 100 with the sleeve 120 located about the center portion 202 of the shell 200. As illustrated, the sleeve 120 is shaped according to the outer shell surface and hence is generally cylindrical. The sleeve 120 is fabricated from a color changing material that includes thermochromatic liquid crystals and thermochromatic dyes. In the preferred sleeve 120, the color changing material is a thermochromatic leuco dye; and, acceptable results have been derived from the use of a leuco dye in a product sold under the name Chromicolor® and manufactured by Matsui International Company, Inc. Currently, Matsui International Company, Inc offers Chromicolor® in the following standard colors: Fast Yellow, Gold Orange, Vermillion, Pink, Magenta, Fast Blue, Turquoise, Brilliant Green, Fast Black, Green, and Brown. In the preferred embodiment, Fast Blue colored Chromicolor® is used.

In the preferred embodiment, the color changing material becomes substantially transparent at elevated temperatures and pigmented at lower temperatures. The temperature at which the color changing material will become transparent or pigmented depends on the nature of the color changing material selected. The following chart provides examples of the temperature characteristics for a variety of color changing materials manufactured by Matsui International Company, Inc. and sold under the trademark Chromicolor®:

CHROMICOLOR ® TEMPERATURE RANGE CHART
Regular Type

| Temperature | Color Appears Below | | Color Disappears Above | |
|---|---|---|---|---|
| Type | ° C. | ° F. | ° C. | ° F. |
| 025 | −25.0 | −13.0 | −15.0 | 5.0 |
| 015 | −13.0 | 8.6 | 0.0 | 32.0 |
| 07 | −4.0 | 24.8 | 5.0 | 41.0 |
| 5 | 1.0 | 33.8 | 12.0 | 53.6 |
| 8 | 5.0 | 41.0 | 14.0 | 57.2 |
| 10 | 8.0 | 46.4 | 16.0 | 60.8 |
| 15 | 11.0 | 51.8 | 19.0 | 66.2 |
| 17 | 14.0 | 57.2 | 23.0 | 73.4 |
| 20 | 16.0 | 60.8 | 26.0 | 78.8 |
| 22 | 20.0 | 68.0 | 29.0 | 84.2 |
| 25 | 22.0 | 71.6 | 31.0 | 87.8 |
| 27 | 24.0 | 75.2 | 33.0 | 91.4 |
| 30 | 25.0 | 77.0 | 35.0 | 95.0 |
| 35 | 27.0 | 80.6 | 36.0 | 96.8 |
| 37 | 32.0 | 89.6 | 41.0 | 105.8 |
| 41 | 35.0 | 95.0 | 44.0 | 111.2 |
| 45 | 40.0 | 104.0 | 50.0 | 122.0 |
| 47 | 44.0 | 111.2 | 58.0 | 136.4 |
| 60 | 53.0 | 127.4 | 65.0 | 149.0 |

In the preferred embodiment, Chromicolor® Temperature Type 60 is utilized and the sleeve 120 is colored purple between about −40° C. and about 65° C. and pink between about 65° C. and about 150° C.

While this invention has been particularly shown and described with references to embodiments thereof, it will be understood by those skilled in the art that various changes in form and details may be made therein without departing from the spirit and scope of the invention as defined by the appended claims.

What is claimed is:

1. A connector, comprising:

a) a shell provided with a port, a shell axis, a shell opening, an inner shell surface, and an outer shell surface;

b) a plurality of clamping members axially located within the shell between a spring and the shell opening, the spring biases the clamping members axially towards the shell opening;

c) an indicator that is located, at least in part, within the shell, axially spaced from the shell opening, and the clamping members being located between the indicator and the shell opening;

d) the shell opening is dimensioned so that a cable and a cable end fits through the shell opening;

e) the shell is dimensioned so that the cable fits between the clamping members when the cable is inserted into the shell; and f) the indicator indicates, at least partially, when the cable is inserted through the shell opening so that the cable end extends axially within the shell past the clamping members, wherein the port is, at least in part, configured to accept at least a portion of the indicator such that the portion of the indicator extends through the port outside the shell, thereby the port provides a visible indication of whether the cable has been inserted axially beyond clamping members.

2. The connector according to claim 1, further comprising an other plurality of clamping members axially located within the shell between a spring and an other shell opening located oppositely from the shell opening, an other indicator indicates, at least partially, when an other cable is inserted through the other shell opening so that a cable end of the other cable extends axially within the shell past the other clamping members.

3. The connector according to claim 1, wherein the shell comprises retaining structures and the clamping members comprise retainers engageable with the retaining structures, and further comprising a release located between the clamping members and generally coaxial with the shell opening to maintain the retainers in engagement with the retaining structures while the spring is compressed, the cable end thereby pushing the release away from the clamping members and freeing the retainers from the retaining structures and the spring thereby forcing the clamping members toward the shell opening.

4. The connector according to claim 1, wherein the indicator comprises a tab connected to a living hinge, the cable end contacting the tab and moving the tab along an arc to push the tab through the port.

5. The connector according to claim 1, wherein the indicator is made of plastic.

6. The connector according to claim 1, further comprising an other plurality of clamping members axially located within the shell between a spring and an other shell opening located oppositely from the shell opening, an other indicator indicates, at least partially, when an other cable is inserted through the other shell opening so that a cable end of the other cable extends axially within the shell past the other clamping members, and the shell comprises retaining structures and the clamping members and other clamping members comprise retainers engageable with the retaining structures, and further comprising releases located between the clamping members and the other clamping members and generally coaxial with the shell opening and the other shell opening to maintain the retainers in engagement with the retaining structures while the spring(s) is compressed, the cable ends thereby pushing the releases away from the clamping members and the other clamping members and freeing the retainers from the retaining structures and the spring(s) thereby forcing the clamping members toward the shell opening and the other clamping members toward the other shell opening.

7. The connector according to claim 6, wherein the indicator comprises tabs with each being connected to a living hinge, the cable ends contacting the tabs and moving the tabs along arcs to push the tabs through the port(s).

8. The connector according to claim 7, wherein the indicator is made of plastic.

9. The connector according to claim 1, wherein the indicator comprises a tab connected to a living hinge, the cable end contacting the tab and moving the tab along an arc to push the tab through the port, and the indicator is made of plastic.

10. The connector according to claim 9, wherein the shell comprises retaining structures and the clamping members comprise retainers engageable with the retaining structures, and further comprising a release located between the clamping members and generally coaxial with the shell opening to maintain the retainers in engagement with the retaining structures while the spring is compressed, the cable end thereby pushing the release away from the clamping members and freeing the retainers from the retaining structures and the spring thereby forcing the clamping members toward the shell opening.

11. The connector according to claim 9, further comprising an other plurality of clamping members axially located within the shell between a spring and an other shell opening located oppositely from the shell opening, an other indicator indicates, at least partially, when an other cable is inserted through the other shell opening so that a cable end of the other cable extends axially within the shell past the other clamping members.

* * * * *